United States Patent [19]

Born

[11] Patent Number: 4,693,060

[45] Date of Patent: Sep. 15, 1987

[54] APPARATUS FOR WRAPPING STACKED GOODS

[76] Inventor: Peter Born, Reutenstrasse 15, 4800 Zofingen, Switzerland

[21] Appl. No.: 931,927

[22] PCT Filed: Nov. 15, 1984

[86] PCT No.: PCT/CH84/00181

§ 371 Date: Jul. 9, 1985

§ 102(e) Date: Jul. 9, 1985

[87] PCT Pub. No.: WO85/02161

PCT Pub. Date: May 23, 1985

Related U.S. Application Data

[63] Continuation of Ser. No. 759,040, Jul. 9, 1985, abandoned.

[30] Foreign Application Priority Data

Nov. 15, 1983 [CH] Switzerland ..... 6125/83

[51] Int. Cl.[4] ..... B65B 13/04

[52] U.S. Cl. ..... 53/588; 53/210

[58] Field of Search ..... 53/210, 556, 586; 100/27, 33 PB

[56] References Cited

U.S. PATENT DOCUMENTS

| | | | |
|---|---|---|---|
| 658,206 | 9/1900 | Collins | 100/27 |
| 904,223 | 11/1908 | Pickens | 100/27 |
| 3,160,088 | 12/1964 | Bunn | 100/27 |
| 3,221,642 | 12/1965 | Ayres | 100/27 |
| 3,930,442 | 1/1976 | Buttner | 53/588 |
| 4,091,723 | 5/1978 | Izawa | 100/33 PB |
| 4,109,445 | 8/1978 | Shulman | 53/588 |
| 4,185,548 | 1/1989 | Pierce | 100/27 |
| 4,235,062 | 11/1980 | Lancaster | 53/556 X |

FOREIGN PATENT DOCUMENTS

| | | | |
|---|---|---|---|
| 2225908 | 5/1972 | Fed. Rep. of Germany | 100/27 |
| 2847523 | 5/1980 | Fed. Rep. of Germany | 100/27 |

*Primary Examiner*—John Sipos

*Attorney, Agent, or Firm*—Steele, Gould & Fried

[57] ABSTRACT

An apparatus for wrapping a load of goods on a pallet with parallel or crosswise running straps has an upper carriage displaceable in elevation. A vertical shaft is secured on the upper carriage and carries a wrapping arm with a horizontal part and a downwardly-projecting perpendicular part, radially spaced from the shaft. A spool of banding material in the form of a thin flat strip is provided above the shaft or on the horizontal part of the wrapping arm, and guiding pulleys at a junction betwen the horizontal and vertical parts, and at a lower discharge end of the vertical part, guide the flat strip to the area of a lower carriage, which is also displacement in elevation and supports a unit adapted to hold, cut and affix the flat strip when wrapped.

12 Claims, 6 Drawing Figures

APPARATUS FOR WRAPPING STACKED GOODS

This is a continuation of application Ser. No. 759,040, filed July 9, 1985, now abandoned.

BACKGROUND OF THE INVENTION

1. Field of the Invention

The invention relates to an apparatus for wrapping a band once or several times around a stack, or the like, of goods, for example a palletized load, wherein said stack remains stationary relative to the apparatus during the wrapping process, said band being dispensed from a wrapping apparatus which orbits around the stack.

2. Prior Art

U.S. Pat. No. 4,109,445 discloses an apparatus of this kind which may be used to wrap plastic film around palletized goods. This apparatus has a horizontal, driven arm which rotates above a pallet, the outer end of which is angled vertically downwards and on the vertical part of which is mounted a film dispensing reel the height of which is adjustable. The film dispensing reel orbits the goods on the pallet and wraps them spirally with strips of film by means of even height adjustment of the arm.

The film dispensing reel and the mechanism located in the vertical part of the arm to provide for the height adjustment of the reel, as set out in U.S. Pat. No. 4,109,445, are so heavy that it is necessary to provide additional supports for the arm. This is a disadvantage since it renders the already laborious construction even more complicated and costly. A further disadvantage lies in the fact that a relatively large amount of space is required to transport the entire reel around the pallet. Furthermore, the apparatus lacks a means of securing the end of the strip of film with the result that manual means are clearly necessary here. Finally, the apparatus is specifically designed to wrap with relatively wide film and is not well suited for use with narrower bands, such as are used for securing purposes, not the least on account of the absence of a possibility for affixing and attaching the ends of the bands.

Devices operable to tie bands are known in the art, per se.

SUMMARY OF THE INVENTION

An object of the prsent invention is to provide a wrapping apparatus having none of the disadvantages of the known machine and which is, in particular, also suitable for wrapping using narrow bands for the purpose of securing stacks of goods.

This problem is solved according to the present invention by an apparatus for the single or multiple wrapping of a stack or the like of goods, with a band, said stack being stationary relative to the apparatus during the wrapping operation, said band being dispensed from a wrapping apparatus which orbits around the stack, characterised in that the wrapping apparatus has a wrapping arm with one horizontal part and one part angled vertically downwards, that the horizontal part is mounted on a vertical shaft, that the wrapping arm has means for guiding the band, that a band supply reel is linked to the horizontal part of the wrapping arm, that the wrapping arm is adjustable for height and that a band securing device of adjustable height is provided for securing and severing the band.

BRIEF DESCRIPTION OF THE DRAWINGS

One embodiment of the instant invention is illustrated in the accompanying drawings in which.

DETAILED DESCRIPTION OF THE PREFERRED EMBODIMENTS

The machine shown has a stand 1 through which passes a pallet conveyor 2. On this latter rests the pallet 29 laden with stacked goods 28 (FIG. 1).

Figure 1:
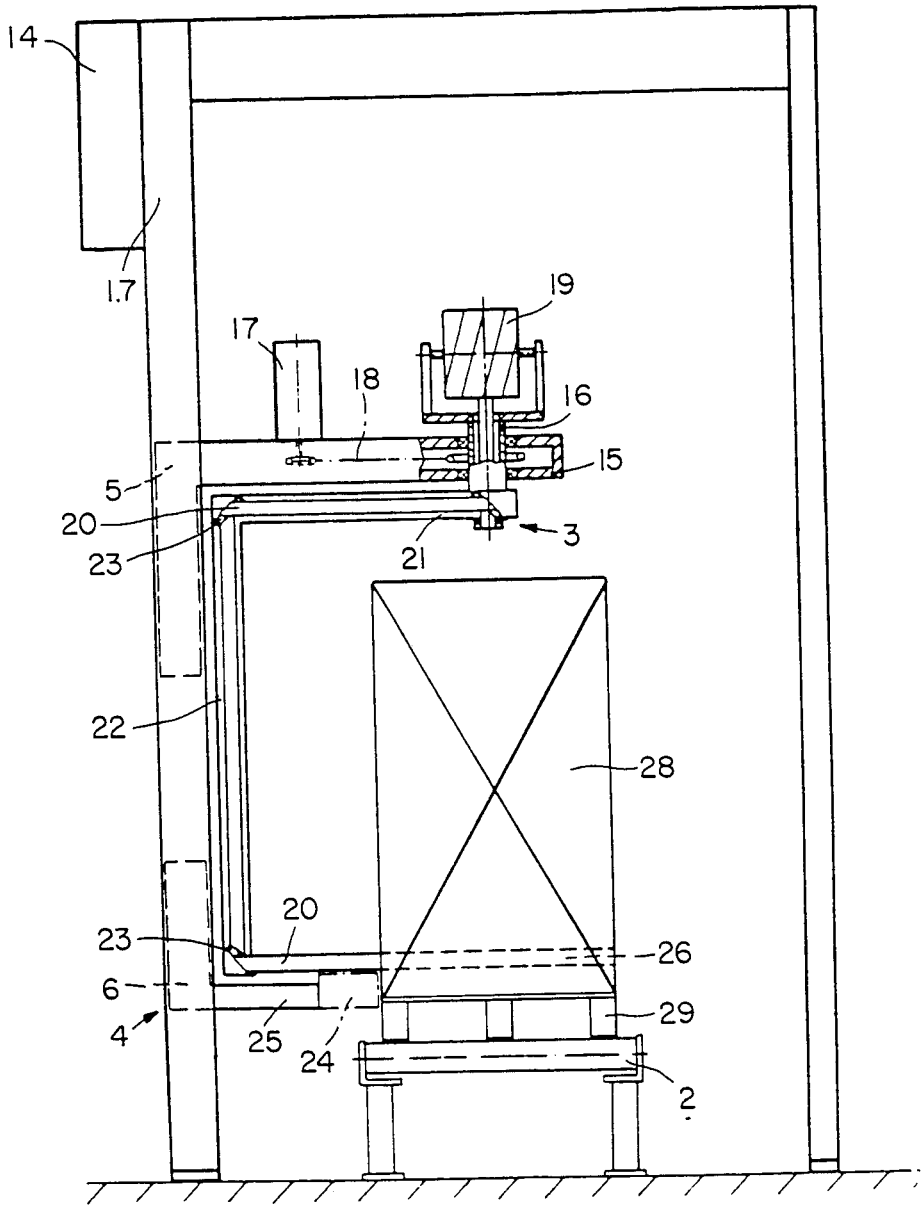
FIG. 1 is a view of an apparatus for the wrapping of stacked goods on pallets, partly in section.
Figure 2:
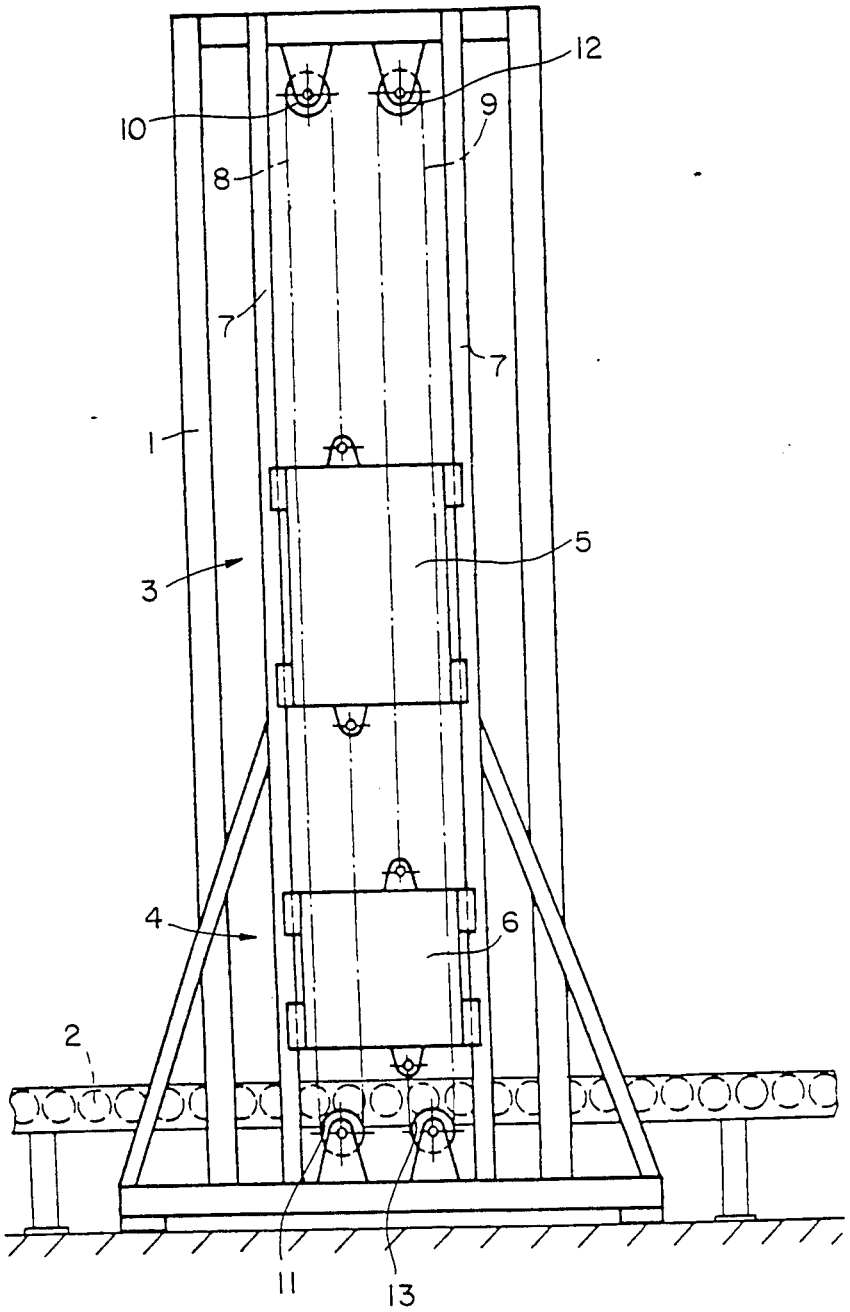
FIG. 2 is a side elevation and FIG. 3 is a plan view of the same apparatus.

Fitted adjustably by means of two vertical rails 7 to stand 1, on the same side of the pallet conveyor 2, are an upper carriage 5 as part of a wrapping apparatus 3 and a lower carriage 6 as part of a band securing means 4 (FIGS. 1 and 2). Both carriages 5, 6 are suspended on separate chain hoists 8, 9 serving as elevating means.

Above the chain hoist 8 for the upper carriage 5 is a chain drive wheel 10, and below it is a chain guide wheel 11 (FIG. 2). The chain hoist 9 for the lower carriage 6 is equipped at its upper end with a chain drive wheel 12 and at its lower end with a chain guide wheel 13.

The drive mechanism for both chain drive wheels 10, 12 is located in a housing 14 (FIG. 1) on stand 1 and is of variable speed. The two chain hoists may either be driven in synchronous motion or, alternatively, chain hoist 8 for the upper carriage 5 of the wrapping apparatus 3 may be driven whilst chain hoist 9 for the lower carriage 6 of band securing means 4 may be disengaged and locked in the desired position.

The upper carriage 5 has an elongated boom 15. On this is situated a hollow shaft 16 which is vertically mounted and which can be made to rotate by a drive motor 17 via a chain 18. The hollow shaft 16 lies in the vertical central axis of the goods 28 and is linked at its upper end with a spool 19 revolving around a horizontal axis carried therewith for the band 20 which latter in the embodiment illustrated is, for example, 1 to 5 cm wide. At the lower end of the hollow shaft 16 is securely mounted the horizontal element 21, 22 of a wrapping arm, the outer end of which is angled vertically downwards. The horizontal element 21 of the wrapping arm and its vertical element 22 are so equipped that a band 20 can pass from the spool 19 through the hollow shaft 16 via pulleys 23 along the horizontal element 21 of the wrapping arm and its vertical element 22. A pulley 23 is also mounted at the lower end of the vertical element 22. From here the free end of the band 20 leads to an apparatus 24 of the band securing means 4 in order to affix, secure and sever it. The securing apparatus 24 is fitted to a shorter outrigger arm 25 of the lower carriage 6.

Figure 3:
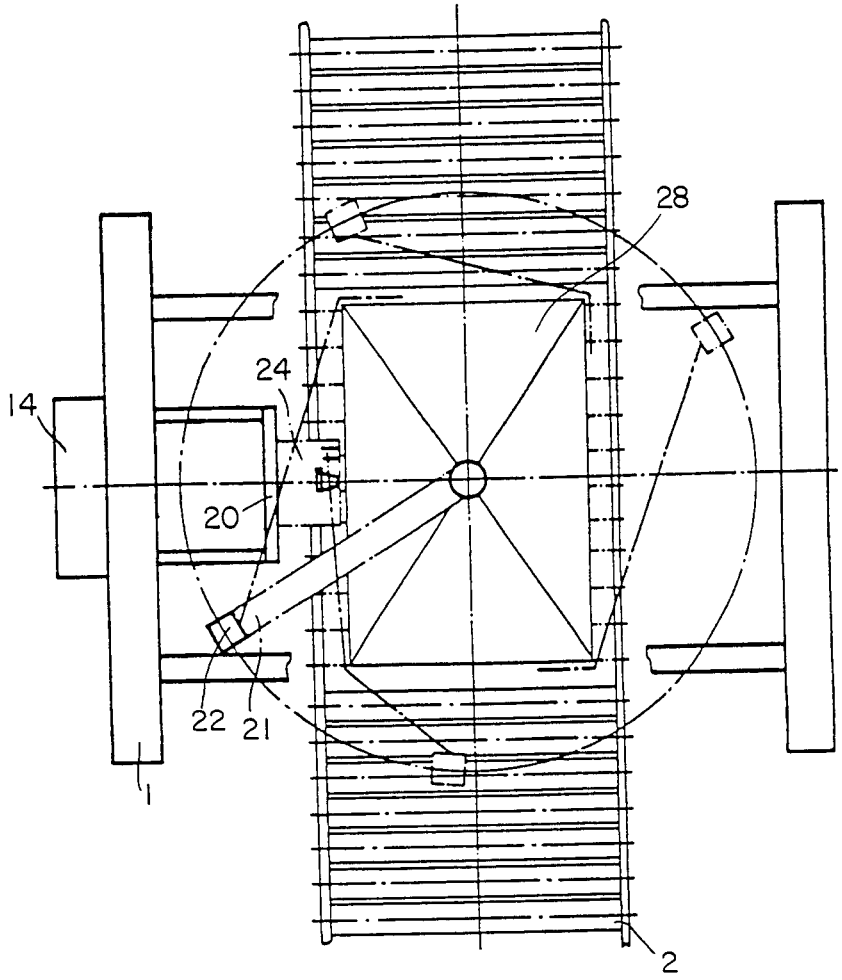
Figure 4:
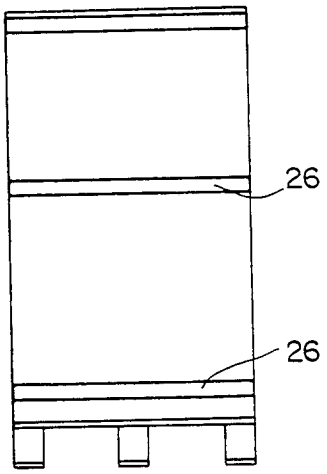
FIG. 4 shows a horizontal, ring arrangement of bands and, FIG. 5 shows a criss-crossed arrangement of bands.

As soon as the vertical central axis of the laden pallet 29 is pushed forwards under the hollow shaft 16, carriages 5, 6 are brought into the position shown in FIG. 1 and the hollow shaft 16 with the wrapping arm elements 21, 22 are caused to revolve so that band 20 forms at least one horizontal winding 26 at the desired height above the pallet 29 (FIGS. 1, 4). In so doing the vertical element 22 of the wrapping arm revolves counterclockwise (FIG. 3) around the laden pallet 29.

In order to tie the ends of a band by knotting on a flat side of goods 28, the ends of the bands are gathered together so that the band always lies completely flat around the edges of the goods 28. Parallel windings may be wound above the lowest horizontal winding 26, for which purpose the two carriages 5, 6 may be moved synchronously. It is also possible for several layers of band 20 to be wound over each other into a winding 26, whereby an apparatus holds the band away from the gripper.

Figure 5:
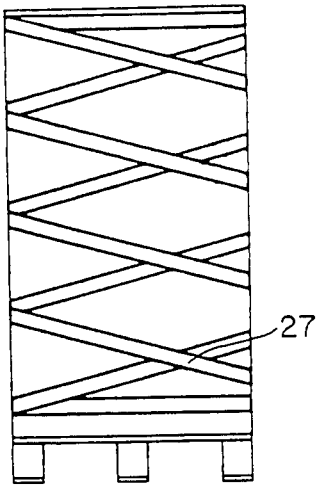

Should it be desired to produce criss-cross windings (FIG. 5), then, after the layers of the lowest horizontal winding have been wound, the lower end of the vertical element 22 of the winding arm rises during the orbiting process to the upper end of the stacked goods 3 whereupon a further horizontal winding is wound. Subsequently carriage 5 with the lower end of orbiting vertical element 22 is once again moved downwards so that the upwards running windings cross with the downwards running windings. The ends of the bands are only knotted together when the lowest horizontal winding has been wound on. The lower and upper winding around the stacked goods 28 may be selected as desired from within the length of travel, as may also be gradient of the helical wrapping. The knotting of the ends of band 20 is controlled in such a way that it is only possible at the appropriate position in the wrapping operation.

Instead of being adjusted by chain hoists, the height adjustments of carriages 5, 6 may be effected by means of threaded spindles or by hydraulic or pneumatic elevating means.

Figure 6:
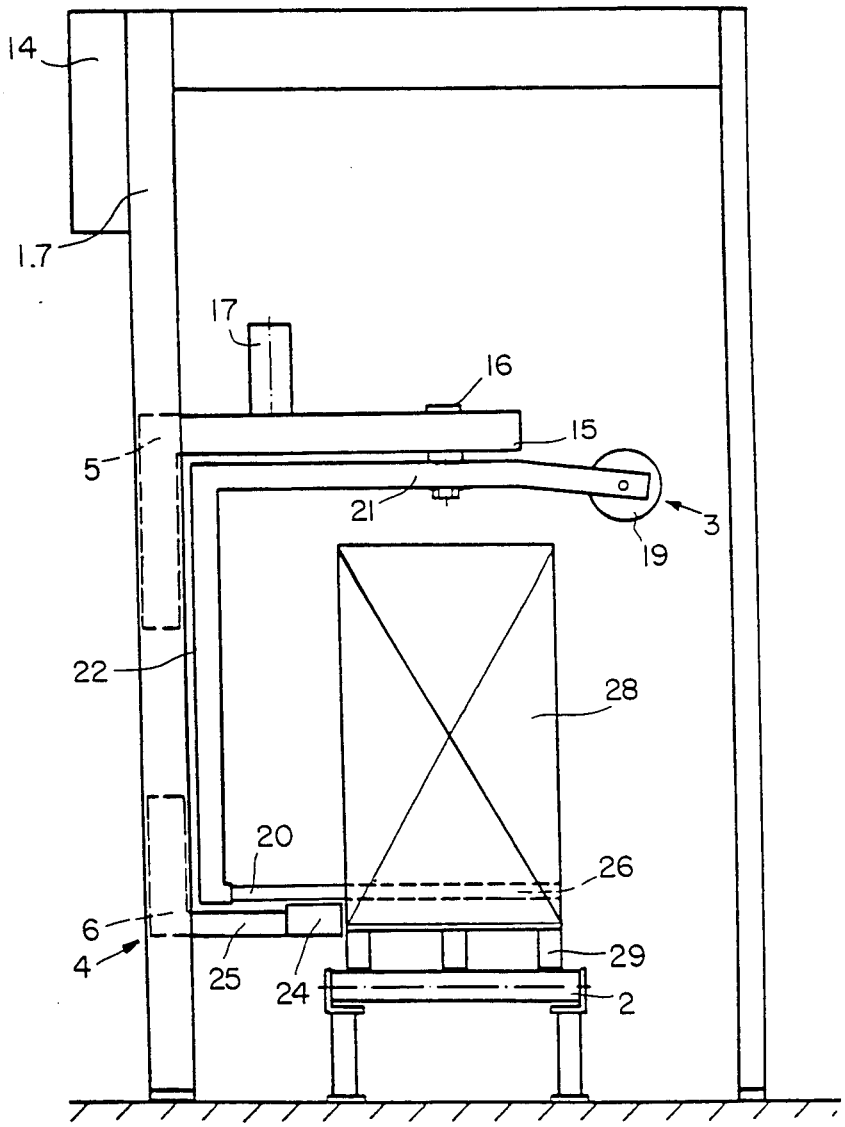
FIG. 6 shows an embodiment of the apparatus with a variant for fitting the band supply reel.

In the embodiment of the invention shown in FIG. 6, the band supply reel 19 is mounted on an extension of the horizontal part 21 of the winding arm instead of above the shaft. In this way the band does not have to be guided through the hollow shaft, but is effected directly in the horizontal part 21 of the winding arm and is thus simpler. In addition, the hollow shaft 16 is then available, if desired, for the mounting of an additional apparatus, for example of a press (not shown). In comparison to the previously described embodiment a greater distance is needed between the boom and the stack.

In another embodiment of the invention, which is not shown in the drawings, not only is the entire wrapping apparatus adjustable in height, but also the vertical element 22 of the wrapping arm is telescopically adjustable in length. This makes it possible to adjust the height entirely or partially by means of this adjustment in length. The telescopic length adjustment may be made in a known manner using threaded spindles or similar means. This dual height adjustability of wrapping apparatus 3 provides additional flexibility. According to another embodiment, the height adjustment of wrapping apparatus 3 is achieved by solely by means of telescopic alteration in the length of vertical portion 22, so that the elevating means may be dispensed with.

Various known processes may be used to bind the ends of the bands, such as clamping, glueing, welding or gathering together and tieing on a flat side of the stack. Devices suitable for these purposes are known.

I claim:

1. An apparatus for wrapping a load of goods with a flat band, the band to be passed along a horizontal and vertical path orbiting the load, the apparatus comprising:

a wrapping arm having a horizontal part and a vertical part angled downwards from the horizontal part and attached to the horizontal part, the horizontal part being mounted on a hollow vertical shaft, the vertical shaft being rotatable to carry the vertical part around the load of goods;

a band supply reel mounted above the hollow vertical shaft, the band being fed inside and through the vertical shaft to the horizontal part of the wrapping arm;

guide means for guiding the flat band from the supply reel, the guide means being disposed along the wrapping arm and guiding the flat band along the horizontal part and down the vertical part to a discharge where the band is dispensed onto the load, the guide means including a first band-guiding means mounted at a junction between the horizontal and the vertical parts, the first band-guiding mean being inclined to the shaft thereby to guide the band around an angle between the horizontal and the vertical parts;

a band securing device for securing and severing the band, the band securing device being movably positionable adjacent the discharge for the band; and, elevating means associated and cooperating with the wrapping arm such that the wrapping arm is continuously displaced in height during at least part of the wrapping operation.

2. An apparatus for wrapping a load of goods with a flat band, the flat band to be wrapped in an orbit around and vertically traversing the load, the apparatus comprising:

a wrapping arm having a horizontal part and a vertical part angled downwards from the horizontal part and attached to the horizontal part, the horizontal part being mounted on a vertical shaft, the wrapping arm being rotatable around the vertical shaft to thereby carry the vertical part around the load of goods;

a band supply reel mounted on a part of the horizontal part of the wrapping arm at an opposite end of the horizontal part from the vertical part and spaced from the vertical shaft, the band being fed along the wrapping arm;

guide means for guiding the flat band from the supply reel, the guide means being disposed along the wrapping arm and guiding the flat band along the horizontal part and down the vertical part to a discharge where the band is dispensed onto the load, the guide means including a first band-guiding means mounted at a junction between the horizontal and the vertical parts, the first band-guiding mean being inclined to the shaft thereby to guide the band around an angle between the horizontal and the vertical parts;

a band securing device for securing and severing the band, the band securing device being movably positionable adjacent the discharge for the band; and, elevating means associated and cooperating with the wrapping arm such that the wrapping arm is continuously displaced in height during at least part of the wrapping operation.

3. The apparatus according to claim 1, further comprising separate elevating means connected to position the wrapping apparatus and the band securing means, respectively are provided with separate elevating means.

4. The apparatus according to claim 3, wherein the elevating means are coupled with each other so that the elevating means are movable in synchronous motion.

5. The apparatus according to claim 3, further comprising a speed control for the elevating means.

6. The apparatus according to claim 3, wherein the elevating means comprise carriages on vertical rails of a stand, the carriages being suspended from a chain drive on the stand.

7. The apparatus according to claim 1, wherein the vertical portion of the wrapping arm is telescopically adjustable.

8. The apparatus according to claim 1, wherein the band-guiding means for the band includes a first pulley mounted at a junction of the horizontal part and the vertical part, the pulley being inclined to the shaft.

9. The apparatus of claim 8, wherein the horizontal and vertical parts are hollow and the guide means include pulleys mounted at an angle with respect to the horizontal and the vertical parts inside said wrapping arm for guiding the band at angles, the band being guided inside and through the wrapping arm.

10. A wrapping apparatus for wrapping a flat band around a load in a path enclosing the load and vertically traversing the load, the apparatus comprising:

a vertical shaft oriented above a wrapping station on a carriage adjustably positionable vertically with respect to the wrapping station.

a wrapping arm having a horizontal part rotatable on the vertical shaft and a vertical part radially spaced from the vertical shaft;

a supply reel disposed adjacent the shaft and above the wrapping station, the supply reel being operable to feed a flat band toward said horizontal part;

guiding means including a first pulley adjacent a junction between the horizontal part and the vertical part, the first pulley being inclined relative to the horizontal part and relative to the vertical part, the first pulley guiding the flat band around a right angle defined at a junction of the horizontal part and the vertical part, and a second pulley adjacent a discharge from the vertical part, the second pulley being inclined relative to the vertical part and guiding the band from the discharge from the vertical part horizontally to the load;

elevating means associated and cooperating with the wrapping arm such that the wrapping arm is continuously displaceable in height during the wrapping operation; and, a band securing device adjacent the discharge, the band securing device being carried on a second vertically adjustable carriage, the band securing device being operable for securing and severing the band.

11. The apparatus according to claim 1 or claim 2, wherein the band supply reel defines a horizontal axis.

12. The apparatus according to claim 10, wherein the supply reel is mounted on an end of the horizontal part of the wrapping arm opposite from the vertical part of the wrapping arm.

* * * * *

UNITED STATES PATENT AND TRADEMARK OFFICE

CERTIFICATE OF CORRECTION

PATENT NO. : 4,693,060

DATED : September 15, 1987

INVENTOR(S) : Peter Born

It is certified that error appears in the above-identified patent and that said Letters Patent is hereby corrected as shown below:

Column 3, line 60, delete "by", first occurrence.

In the abstract, line 10, delete "betwen" and insert --between--.

Signed and Sealed this

Thirteenth Day of June, 1989

*Attest:*

*Attesting Officer*

DONALD J. QUIGG

*Commissioner of Patents and Trademarks*